United States Patent [19]

Justus

[11] 4,146,424

[45] Mar. 27, 1979

[54] TWIN WIRE FORMER WITH WIRE ORIENTATION CONTROL

[75] Inventor: Edgar J. Justus, Beloit, Wis.

[73] Assignee: Beloit Corporation, Beloit, Wis.

[21] Appl. No.: 804,493

[22] Filed: Jun. 8, 1977

[51] Int. Cl.[2] ..... D21F 1/24

[52] U.S. Cl. ..... 162/199; 162/203; 162/257; 162/273; 162/301

[58] Field of Search ..... 162/132, 198, 199, 203, 162/257, 273, 299, 301, 352; 74/241

[56] References Cited

U.S. PATENT DOCUMENTS

| | | | |
|---|---|---|---|
| 2,881,675 | 4/1959 | Thomas | 162/203 |
| 2,988,141 | 6/1961 | Madden et al. | 162/257 |
| 3,994,774 | 11/1976 | Halme et al. | 162/273 |

*Primary Examiner*—Richard V. Fisher

*Attorney, Agent, or Firm*—Hill, Gross, Simpson, Van Santen, Steadman, Chiara & Simpson

[57] ABSTRACT

An apparatus and method for making a paper web with a traveling fourdrinier wire and a looped mating wire pressed into the fourdrinier wire along a forming run and a headbox with a slice for delivering stock at the head end of the forming run, the mating wire being supported on rotatable rolls fixedly carried on a frame with the frame supported for pivotal shifting movement about an axis at right angles to the plane of the fourdrinier wire so that the entire carrying unit for the mating wire is shifted to cause it to track properly.

9 Claims, 2 Drawing Figures

TWIN WIRE FORMER WITH WIRE ORIENTATION CONTROL

BACKGROUND OF THE INVENTION

Figures 1, 2:
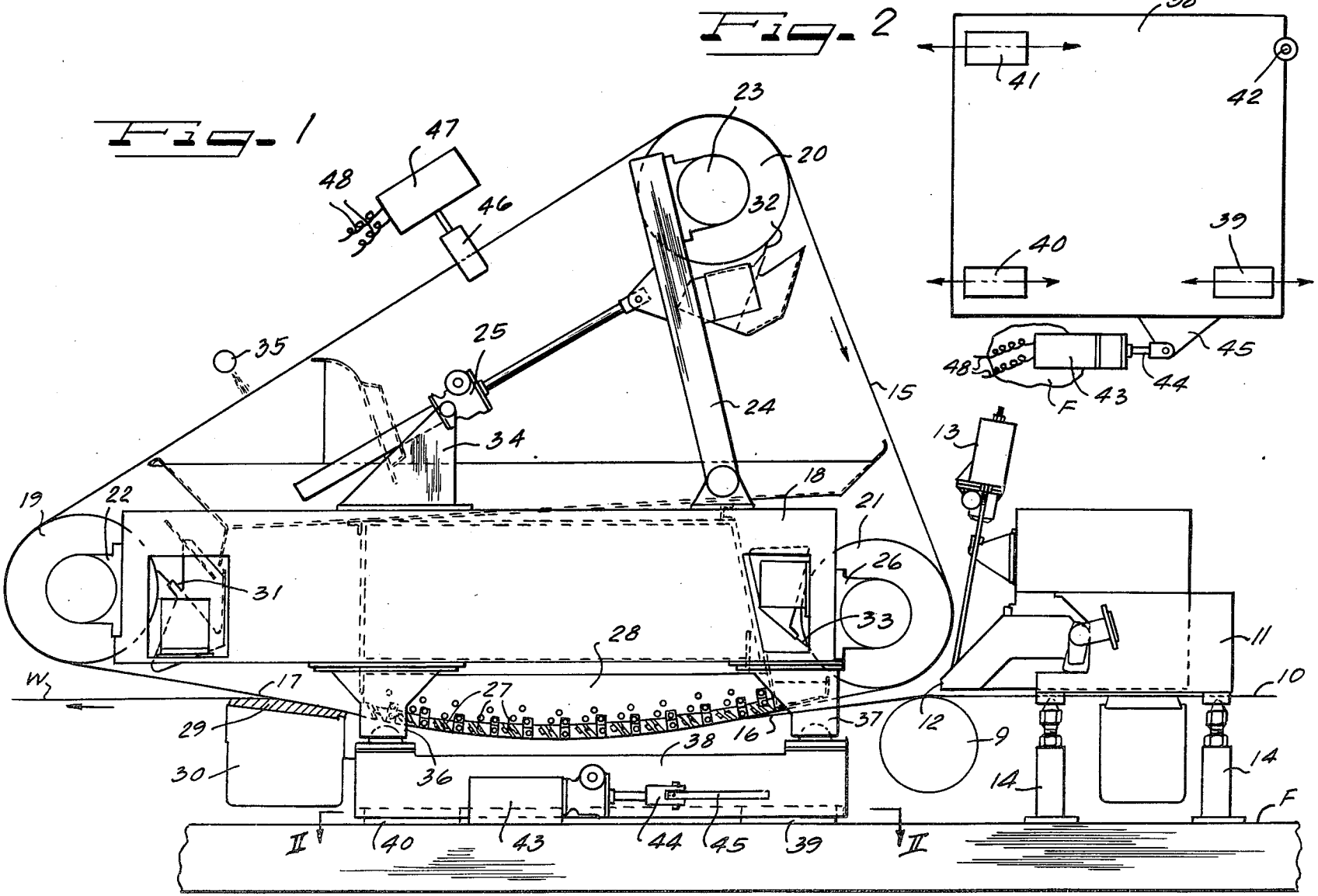

The present invention relates to improvements in paper making machines, and more particularly to a twin wire machine of the type capable of making a multi-ply paper web with improved means for controlling the relative running positions of the wires.

In high speed traveling wire paper making machines, the positions of the wire must be controlled so that they do not skew sideways and so that the web remains in a uniform lateral position during continuing operation. Conventionally, this has been done by mounting the supporting bearing at one end of one of the wire support rolls so that the bearing can shift forward or rearward in a machine direction to regulate the running position of the wire. That is, as the end of the roll shifts either toward the oncoming wire or with the direction of the traveling wire, the wire will tend to skew to the left or right depending on how the roll end changes.

With twin wire machines wherein two wires are run together in close running relationship along a forming run, the position of both wires must be controlled. An example of such an installation is in a multi-ply paper web machine wherein the lower wire is a fourdrinier, and a series of upper forming wires are pressed into the fourdrinier at successive locations with an additional layer of web formed at each location. It has been found to involve a relatively complicated and expensive equipment to control the lateral position of the upper looped forming wire by constructing one of the guide rolls so as to be shiftable. Such shiftable roll requires equipment strong enough to support the bearings at each end with the bearing at one end being pivotally mounted and the bearing at the other end being shiftably mounted so as to shift forward or rearwardly in the direction of wire travel.

An important object of the present invention is to provide an improved device which will make it unnecessary to provide a shiftable wire guide roll within the looped forming wire of a twin wire machine.

A further object of the invention is to provide an improved twin wire machine wherein the tracking location of the mating or auxiliary wire of a twin wire machine is controlled by supporting the wire on rotatable rolls fixedly located on a frame and shifting the position of the entire frame relative to the main fourdrinier wire.

A still further object of the invention is to provide an improved method and structure for changing the tracking location of the supporting frame and rolls of a mating wire in a twin wire paper making machine.

Other objects, advantages and features will become more apparent, as well as equivalent structures which are intended to be covered herein, with the teaching of the principles of the present invention in connection with the disclosure of the preferred embodiments thereof in the specification, claims and drawings, in which:

DRAWINGS

FIG. 1 is a somewhat schematic side elevational view of a portion of a twin wire paper making machine constructed and operating in accordance with the principles of the present invention; and FIG. 2 is a somewhat schematic horizontal sectional view taken substantially along line II—II of FIG. 1.

DESCRIPTION

As illustrated in FIG. 1, the mechanism has a traveling fourdrinier wire 10 which is supported and carried on rolls including a breast roll 9. A couch roll and other wire supporting rolls are provided in the usual manner, and these rolls are omitted from the drawing and their structures and positions will be fully understood by those versed in the art. Positioned above the fourdrinier wire 10 is a headbox 11 with a slice 12 for discharging stock onto the traveling wire. Principally, the slice is provided for the purposes of providing a fibrous paper making stock into the forming zone between the lower fourdrinier wire 10 and an upper looped forming wire 15 with the forming zone extending essentially from location 16 to location 17 through which the wires run in close running adjacent web forming engagement, preferably with the upper wire pressed into the lower wire as illustrated.

The slice is adjustable in position, and the upper slice lip is constructed adjustable by means of a screw jack 13 so as to control the quantity of stock deposited onto the wire.

The arrangement is well adapted to use a machine for making multiple layered webs, and in such operation a first layer will be formed on the wire 10 through the forming zone and at the offrunning side, the web layer will follow the lower wire 10 at the location W to a second station where another fourdrinier will place a second layer of stock on the web and another upper unit having a looped forming wire similar to the one illustrated will be provided for forming the second layer of the web on the first. Additional layers will be formed in accordance with the product to be made.

The headbox is supported on a mill floor F by adjustable legs 14 which are located at the side of the headbox outside of the edges of the fourdrinier wire 10. While the fourdrinier wire 10 may be referred to as the lower wire and the mating wire 15 as the upper wire, it will be understood that this is not to be considered limiting as to their relative locations, and the unit may run in a vertical position or with the positions of the two wires reversed.

The upper wire 15 is supported as a unit on a frame 18 with rotatable rolls 19, 20 and 21 in relatively fixed positions on the frame. The rolls are respectively carried in bearings 22, 23 and 26 with the bearings 22 and 26 fixedly mounted on the frame, and the bearing 23 mounted on a swing arm 24 which is adjustable by a screw jack 25 on a brace 34 so as to tension the looped upper wire 15. The bearings are constructed so that the axis of each of the three rolls are parallel and no means need be provided to skew the axis of any of the rolls for training the wire 15 in the proper lateral cross machine direction on the rolls.

Each of the rolls are provided with a cleaning doctor as illustrated at 31, 32 and 33, and the doctors 31 and 33 can be fixedly mounted on the frame, and the doctor 32 fixedly mounted on the swing arm 24. A wire cleaning water jet 35 is positioned in a convenient location supported by suitable means at its ends.

Along the forming run, the upper wire 15 is provided with blades or foils within to remove water expressed from the stock due to pressure between the wires while it is traveling along the forming run. These foils are shown at 27 and are mounted at suitable supports on the inner surface of the wire 15 and the foils 27 are arranged in a generally arcuate path so that the forming wires extending from foil to foil will follow a general arcuate path through the forming zone. At the end of the forming zone, the wires separate with the web following the fourdrinier wire and the fourdrinier wire is wrapped over a suction box 30 having a curved perforate wire engaging top 29.

The upper frame unit 18 with its rolls 19, 20 and 21 is positioned centered vertically over the fourdrinier wire 10. That is, considering the frame 18 having a central axis which extends in a machine direction down the center of the frame, this center axis will extend parallel to the center of the general plane of the fourdrinier wire 10. By shifting the upper frame 18 with its rolls and supported upper wire 15 so that the axis pivots laterally parallel to the plane of the fourdrinier wire, the upper wire 15 will be caused to track in the proper location on its supporting rolls due to the reactive forces on the upper wire 15 along the forming zone. This avoids the necessity of having to construct one of the supporting rolls, such as 19, 20 or 21, so that its bearing support at its ends are pivotal and avoids the necessity of having to provide operating equipment on the upper frame which controls the pivotal position of such a roll. The rolls will be maintained on parallel axes at all times so that the wire is evenly stretched across its width.

To change the position of the frame 18 for the upper wire 15, it is provided with a base 38 carried on shiftable bearings. The upper frame is mounted on side legs 36 and 37 at the edges of the wire which seat on the base 38. The base itself is pivotally mounted, and preferably the pivot is located at the head end of the base 38 as shown at 42 in FIG. 2. The pivot 42 is shown in a preferred form located at one corner of the base 38 with the other corners supported on flat horizontal slide bearings 39, 40 and 41. These slide bearings may be of various suitable commercial types such as known as a Lubrite bearing, or a bonded Teflon bearing, or a water hydrostatic bearing may be employed. A large bearing is preferred with a very low initial starting resistance so that the upper frame can be shifted rapidly and for very small increments to very accurately maintain the upper wire 15 in position.

To apply power to shift the position of the upper unit, a screw jack 43 is mounted on the floor F with a connecting rod 44 pivotally connected to an arm 45 secured to the base 38. The screw jack 43 is opeated by a mechanism which senses the position of the wire, and this mechanism has a paddle 46 engaging the edge of the wire, FIG. 1. The position of the paddle is sensed by a support 47 which provides an output signal which is transmitted to the screw jack 43. This may be done electrically through connecting wires 48, and various known servo mechanisms may be employed to operate the screw jack responsive to the position of the paddle 46.

It has been discovered that the position of the upper wire 15 can be accurately controlled and is immediately responsive to the changing of the pivotal position of the frame 18. The four point support shown in FIGS. 1 and 2 is a preferred arrangement, but in certain installations, space or other construction requirements may indicate that other forms of support may be employed, and the pivot, for example, can be located at the center of the lead end of the frame 38 or on the trailing end, or at the center of the frame, and the other slidable support bearings arranged so as to permit pivotal shifting of the frame support for the upper wire. The support arrangement makes it possible to shift the axis of the frame supporting the upper wire in a plane parallel to the fourdrinier wire so that the unit is pivoted to the left or right and the upper wire will track accordingly due to the reactive forces between the upper wire and the lower wire in the forming zone.

Thus, it will be seen that I have provided an improved mechanism for the control of the relative positions of the wires in a twin wire machine which meets the objectives and advantages set forth. The arrangement accomplishes a simplified construction eliminating the expense of a pivotal roll and makes it possible to use a support unit for the support wire wherein all the rolls operate on parallel axes. The arrangement automatically accommodates alignment between the upper unit and the lower fourdrinier wire, and initial aligning procedures heretofore necessary are eliminated. A uniform rapid control of wire position is achieved which in turn improves the uniformity and quality of the paper web which is made.

I claim as my invention:

1. An apparatus for making a paper web comprising in combination:

a traveling fourdrinier wire for receiving a stock slurry thereon and dewatering the slurry to form a web;

support means for the fourdrinier wire to guide it in a predetermined path of travel;

a looped mating wire in close running engagement with the fourdrinier wire along a forming run with the stock also being dewatered through said mating wire;

stock supply means delivering stock to the forming run between the wires;

a mating wire frame carrying spaced rotatable rolls supporting the looped mating wire and having an axis extending in the machine direction in a plane generally parallel to the fourdrinier;

a support for said frame accommodating movement of said frame relative to the fourdrinier wire for changing the direction of the axis in said plane to change the position of said rolls and the tracking position of the mating wire relative to the fourdrinier wire;

and control means connected to said frame for changing the position of the frame axis in said plane so that the mating wire will track in optimum position relative to the fourdrinier wire.

2. An apparatus for making a paper web constructed in accordance with claim 1 in which:

said frame and rolls for the mating wire are located so that the mating wire is pressed into the fourdrinier wire.

3. An apparatus for making a paper web constructed in accordance with claim 2 including:

a plurality of spaced parallel foil members within said mating wire loop located to press the mating wire into the fourdrinier wire over an arcuate path.

4. An apparatus for making a paper web constructed in accordance with claim 1 including:

a pivotal mount for said frame with the axis of the pivot being transverse to the axis of the frame for shifting movement of the frame about said pivotal mount.

5. An apparatus for making a paper web constructed in accordance with claim 1 including:

means responsive to the position of said mating wire connected to said control means and operating said control means for maintaining the mating wire in a predetermined location relative to the fourdrinier wire.

6. An apparatus for making a paper web constructed in accordance with claim 1 wherein:

said support includes a pivot for pivoting the frame about an axis transverse to said plane and with said pivot located at one corner of said frame and additionally including slides on the remaining three corners of the frame for movement of the frame in said plane.

7. An apparatus for making a paper web constructed in accordance with claim 1 including:

means responsive to the lateral position of said mating wire producing an output signal indicative of mating wire position and means for supplying said output signal to said control means and operating the control means for moving the frame in said plane to maintain the mating wire in a predetermined position.

8. In an apparatus for making a paper web having a fourdrinier wire, a looped mating wire in close running engagement with the fourdrinier wire defining a forming run therebetween for dewatering stock through said wires and means for delivering stock between the wires, the method of maintaining the wires in a predetermined tracking relationship including the steps of operating the fourdrinier wire along a predetermined path and shifting the entire support for the mating wire including a frame and supporting rolls in a pivotal movement so that the axis of the mating wire in a machine direction will change so that the mating wire will track properly relative to the fourdrinier wire.

9. The method set forth in claim 8 wherein the frame and supporting rolls of the mating wire are moved about a pivot extending at right angles to the general plane of the fourdrinier wire with the pivot point being located substantially at the lead end of the forming run.

* * * * *